United States Patent [19]

Speegle et al.

[11] 4,448,216

[45] May 15, 1984

[54] SUBSURFACE SAFETY VALVE

[75] Inventors: Steven C. Speegle, Flower Mound; Kenneth L. Schwendemann, Lewisville; Michael B. Vinzant, Carrollton; Robert W. Crow, Irving; Cary G. Mondon, Carrollton, allof, Tex.

[73] Assignee: Otis Engineering Corporation, Dallas, Tex.

[21] Appl. No.: 358,313

[22] Filed: Mar. 15, 1982

[51] Int. Cl.[3] ..... F16K 31/163

[52] U.S. Cl. ..... 137/630; 166/324; 166/332; 251/58

[58] Field of Search ..... 137/629, 630; 166/324, 166/332; 251/58

[56] References Cited

U.S. PATENT DOCUMENTS

| | | | |
|---|---|---|---|
| 3,703,193 | 11/1972 | Raulins | 137/630 |
| 3,826,462 | 7/1974 | Taylor | 251/58 |
| 3,865,141 | 2/1975 | Young | 137/629 |

*Primary Examiner*—Robert G. Nilson

*Attorney, Agent, or Firm*—Thomas R. Felger

[57] ABSTRACT

A surface controlled subsurface safety valve having a ball type valve closure. The ball member and its associated components are protected from damage by preventing excessive control fluid pressure from applying force to the ball member. Also, rotation of the ball member is prevented until any difference in pressure across the ball member and its seating surface has decreased below a preselected safe value.

14 Claims, 17 Drawing Figures

SUBSURFACE SAFETY VALVE

BACKGROUND OF THE INVENTION

1. Field of the Invention

This invention relates to surface controlled subsurface safety valves used in oil and gas wells.

2. Description of the Prior Art

Surface controlled subsurface safety valves are commonly used in various types of wells to provide downhole protection if a failure or hazardous condition should occur at the well surface. U.S. Pat. No. 3,703,193 to George M. Raulins discloses a typical ball valve and equalizing mechanism used for this purpose. U.S. Pat. No. 3,826,462 to Frank H. Taylor discloses an alternative configuration for a subsurface safety valve. U.S. Pat. No. 3,865,141 to David E. Young discloses a flapper type subsurface safety valve which has a pressure equalizing system that enables reopening the valve after closure while minimizing the risk of damage to the flapper element and/or operating tube. The above patents are incorporated by reference for all purposes within this application.

SUMMARY OF THE INVENTION

The present invention discloses a surface controlled subsurface safety valve having a ball type valve closure means for controlling fluid flow therethrough, comprising a housing means with a longitudinal passageway therethrough; an operating sleeve and attached piston means slidably disposed within the longitudinal passageway; the valve closure means disposed within the longitudinal passageway; means for communicating control fluid pressure with the piston means; means for connecting the valve closure means to the operating sleeve whereby longitudinal movement of the operating sleeve causes longitudinal movement of the valve closure means within the housing means; biasing means which generates a force opposing longitudinal movement of the valve closure means in one direction; an equalizing means which is opened by longitudinal movement of the operating sleeve in the one direction; and the biasing means causing longitudinal movement of the valve closure means in the other direction to permit fluid flow therethrough after fluid pressures on opposite sides of the valve closure means have equalized.

One object of the present invention is to provide a surface controlled subsurface safety valve having a ball type valve closure means that can be reopened with a minimum risk of damage to the ball and its associated components.

Another object of the present invention is to provide a pressure equalizing system which will equalize any pressure differential across a ball type valve closure prior to applying forces which will rotate the ball to its open position.

A further object of the present invention is to provide an operating piston and equalizing system which will protect a ball type valve closure means from excessive force without regard to the amount of control fluid pressure supplied from the well surface to the safety valve.

A still further object of the present invention is to provide a valve actuator which applies a relatively constant, uniform force to rotate a ball type valve closure from its closed to open position without regard to changes in control fluid pressure or formation fluid pressure.

Additional objects and advantages of the present invention will be readily apparent to those skilled in the art from reading the following description in conjunction with the drawings and claims.

DESCRIPTION OF THE PREFERRED EMBODIMENT

Figure 1:
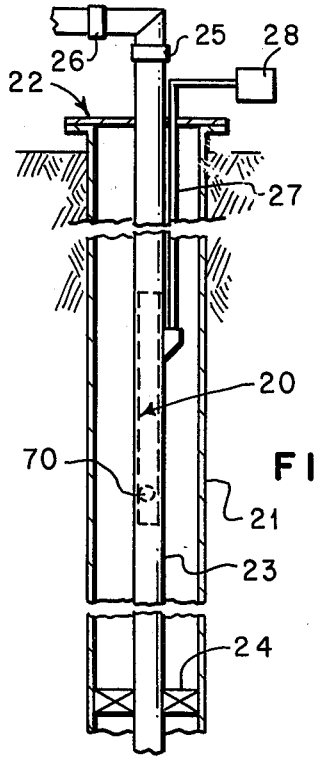
FIG. 1 is a schematic view, partially in section and partially in elevation, of a typical well installation having a surface controlled subsurface safety valve.

A typical well installation having a surface controlled subsurface safety valve 20 is shown in FIG. 1. The well bore is partially defined by casing string 21 which extends from wellhead 22 at the surface to a subsurface hydrocarbon producing formation (not shown). Tubing string 23 is disposed within casing 21 to conduct hydrocarbon fluid flow to the well surface. Production packer 24 forms a fluid barrier between the exterior of tubing 23 and the inner wall of casing 21 to direct fluid communication from the producing formation to the well surface via tubing 23. Valves 25 and 26 are provided at the well surface to control fluid flow from tubing 23. Safety valve 20 is releasably secured within tubing 23 to block fluid flow therethrough in the event of damage to wellhead 22 or other hazardous conditions at the well surface. U.S. Pat. No. 3,826,462 discloses a locking mandrel and landing nipple which can be used to install safety valve 20 within tubing string 23.

Fluid pressure is directed from the well surface to safety valve 20 via small diameter conduit 27 to control the opening and closing of safety valve 20. Control manifold 28 contains the pumps, accumulators, valves and sensors which are normally associated with a surface controlled subsurface safety valve.

Referring to FIGS. 2A–D, safety valve 20 is shown in its first or closed position. Safety valve 20 is designed so that when the pressure of control fluid within conduit 27 exceeds a preselected value, safety valve 20 will open allowing fluid communication through tubing string 23. When control fluid pressure within conduit 27 decreases below a preselected value, safety valve 20 will close blocking fluid communication through tubing string 23. Safety valve 20 is defined by housing means 30 which has several subassemblies for ease of assembly and manufacture. Each subassembly is basically a hollow cylinder with matching threads 31 on opposite ends thereof. Threads 31 allow each subassembly to be concentrically aligned with and attached to adjacent assemblies. The resulting housing means 30 is a relatively long cylinder with a generally uniform outside diameter and longitudinal passageway 32 extending therethrough. O-rings or seal rings 33 are positioned adjacent to each threaded connection 31 to provide a fluid barrier between the interior and exterior of housing means 30.

Threads 35 are provided at the extreme end of housing subassembly 30*a* for use in attaching safety valve 20 to a conventional locking mandrel (not shown). The locking mandrel is used to releasably anchor safety valve 20 within tubing string 23. Packing means 34, carried on the exterior of housing subassembly 30*b*, cooperate with similar packing means (not shown) on the locking mandrel to direct control fluid communication from conduit 27 to opening 36 through the exterior of housing subassembly 30*a*. Various alternative designs are well known and can be used with the present invention for communicating control fluid from the well surface to opening 36. Packing means 34 also blocks communication between control fluid and formation fluid within tubing string 23 and directs formation fluid flow through longitudinal passageway 32.

Operating sleeve 40 is slidably disposed within housing means 30. For ease of manufacture and assembly, operating sleeve 40 consists of subassemblies 40*a*, 40*b* and 40*c*. Each subassembly is a hollow tube or cylinder which abuts the adjacent subassembly and is concentrically aligned therewith. The interior of operating sleeve 40 partially defines the principal flow path (longitudinal passageway 32) for formation fluids through safety valve 20.

Piston means 41 is attached to and forms a part of the exterior of operating sleeve subassembly 40*a*. Piston means 41 and operating sleeve subassembly 40*a* are slidably disposed within housing subassembly 30*a*. Stationary seal or o-ring 42 is carried on the inside diameter of housing subassembly 30*a* and forms a fluid tight barrier with the exterior of sleeve 40 spaced longitudinally from piston means 41. Variable volume control fluid chamber 43 is partially defined by stationary seal 42 and piston means 41. Opening 36 through the wall of subassembly 30*a* communicates control fluid between control chamber 43 and conduit 27. Chamber 43, opening 36, and conduit 27 cooperate to provide means for communicating control fluid pressure with piston means 41.

Sleeve subassembly 40*a* abuts subassembly 40*b* at shoulder 44 within end 45 of subassembly 40*b*. In the same manner subassembly 40*b* abuts subassembly 40*c* at shoulder 46 within end 47. Ends 45 and 47 have enlarged inside diameters to receive cylinders 40*a* and 40*b* respectively therein. Ends 45 and 47 also have enlarged outside diameters as compared to the remainder of sleeve 40. This enlargement of ends 45 and 47 provides external shoulders 48 and 49 for engagement with resilient means 50. Housing subassemblies 30*b* and 30*c* surround resilient means 50 and the major portion of cylinders 40*b* and 40*c* respectively. Housing subassembly 30*b*, which is threadedly engaged with subassembly 30*c*, provides shoulder 51 on the interior of subassembly 30*b*. Shoulder 52 is provided in a similar manner on the interior of housing subassembly 30*c*. Resilient means 50 are disposed between both shoulders 48 and 51 and shoulders 49 and 52 and surround the exterior of operating sleeve 40. Resilient means 50 oppose the forces acting on operating sleeve 40 caused by control fluid pressure within chamber 43. By installing additional housing subassemblies such as 30*c* and operating sleeve subassemblies such as 40*b*, the number of resilient means 50 can be varied for the specific well installation.

Figure 5:
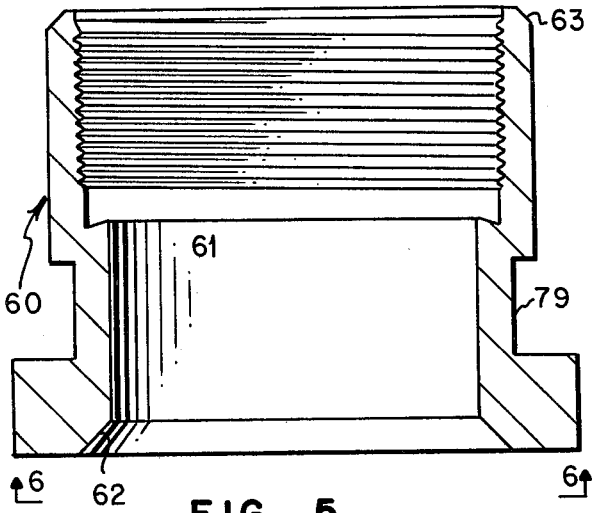
FIG. 5 is a drawing, in longitudinal section, of the upper movable valve seat which comprises a portion of the valve closure means.
Figure 6:
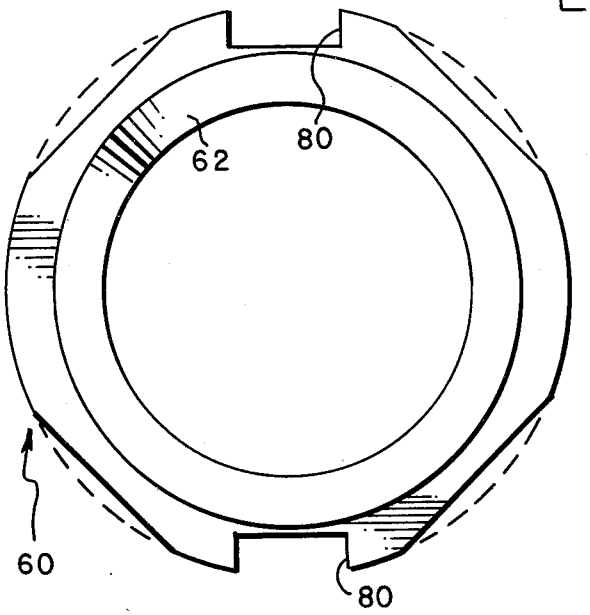
FIG. 6 is an end view of the upper movable valve seat shown in FIG. 5.
Figure 7:
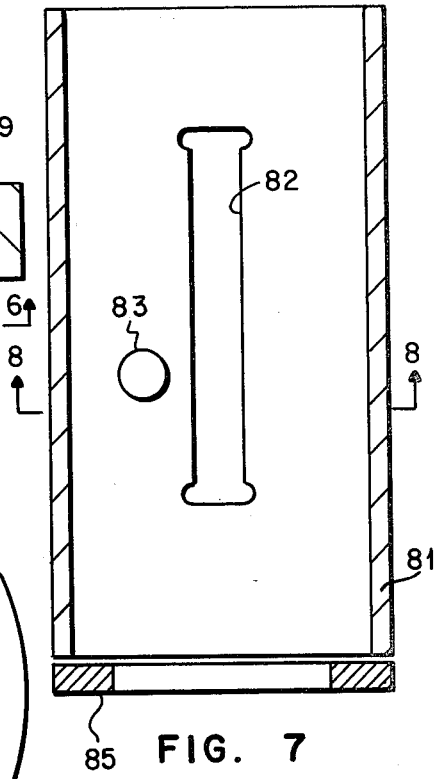
FIG. 7 is a drawing, in longitudinal section, of a rotating sleeve which is slidably disposed around the ball member of the valve closure means shown in FIG. 4A.

Upper movable valve seat or first seat means 60 is attached by threads 61 to the end of operating sleeve subassembly 40*c* opposite from subassembly 40*b*. Enlarged views of upper valve seat 60 are shown in FIGS. 5 and 6. Seat 60 is generally cylindrical with sealing surface 62 having a radius to match the exterior of ball 70. Surface 62 is preferably formed from a hard metal to maintain sealing contact with the exterior of ball 7. When ball 70 is rotated so that its bore 71 is normal to longitudinal passageway 32, ball 70 and sealing surface 62 cooperate to prevent fluid flow through safety valve 20.

Upper valve seat 60 also carries an annular seal 63 which contacts a matching seating surface 64 on the interior of housing subassembly 30*d* adjacent thereto. Preferably, seal 63 and surface 64 will be formed from hardened metal. However, elastomeric material could be used in either seal 63 or surface 64. Seal 63 and surface 64 plus first port means 65 cooperate to provide safety valve 20 with means for equalizing fluid pressure differences across ball 70.

When operating sleeve 40 moves longitudinally in one direction, seals 63 and 64 disengage before ball 70 starts to rotate. When seals 63 and 64 are no longer in contact, formation fluids can bypass ball 70 and enter longitudinal passageway 32 above ball 70 through port means 65. Second port means 66 are provided in housing subassembly 30*e* to ensure a fluid communication path through housing means 30 to ports 65. This feature allows any pressure difference across ball 70 and sealing surface 62 to equalize before rotating ball 70 to align bore 71 with longitudinal passageway 32. Thus, increasing control fluid pressure in chamber 43 above a preselected value will overcome the force of resilient means 50 and slide operating sleeve 40 longitudinally in the one direction to open the equalizing flow path. The equalizing flow path from the exterior of housing means 30 via ports 66 and 65 to longitudinal passageway 32 is best known in FIG. 3B.

Conventional ball type safety valves as shown in U.S. Pat. No. 3,703,193 use the same longitudinal movement of the operating sleeve to open both the equalizing passageway and to rotate the ball member to its open position. Safety valves with this conventional design are subject to damage from excessive control fluid pressure forcing the operating sleeve to attempt to rotate the ball member before differential pressure is equalizing there across. Control fluid pressure in chamber 43 of the present invention can move ball member 70 longitudinally within housing subassembly 30*e* but does not rotate ball member 70 to its open position.

Spacer ring 72 is slidably disposed around the exterior of operating sleeve subassembly 40*a* on the side of piston means 41 opposite from chamber 43. Shoulder 73 is formed on the interior of housing means 30 and longitudinally separated from spacer ring 72 when safety valve 20 is in its first or closed position. Shoulder 73 and spacer ring 72 define the maximum length of travel of operating sleeve 40 in the one direction within housing means 30. Therefore, since generated by excessive control fluid pressure in chamber 45 is transmitted from piston 41 directly to housing means 30 via spacer ring 72 and shoulder 72 and does not act upon ball member 70. Various combinations of spacer rings and shoulders are possible depending upon the desired length of travel for operating sleeve 40. Also, the location of shoulder 73 and piston 41 could be designed to eliminate the need for spacer ring 72.

Figure 10:
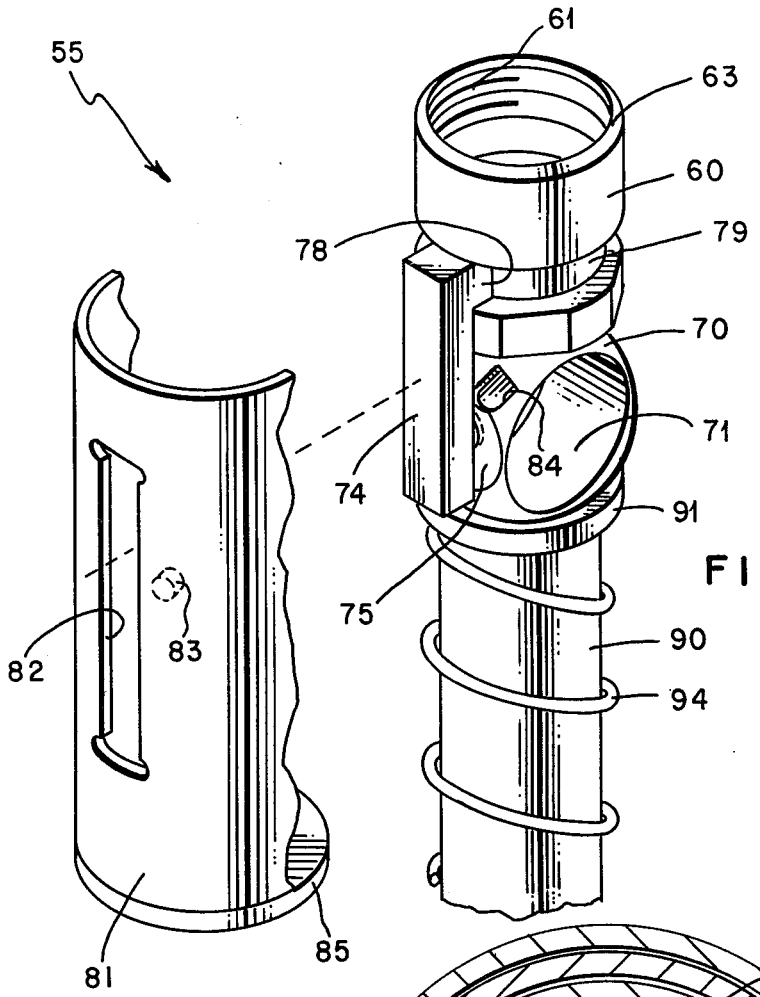
FIG. 10 is an isometric view, with portions broken away, of the valve closure means shown in FIG. 2C.
Figure 11:
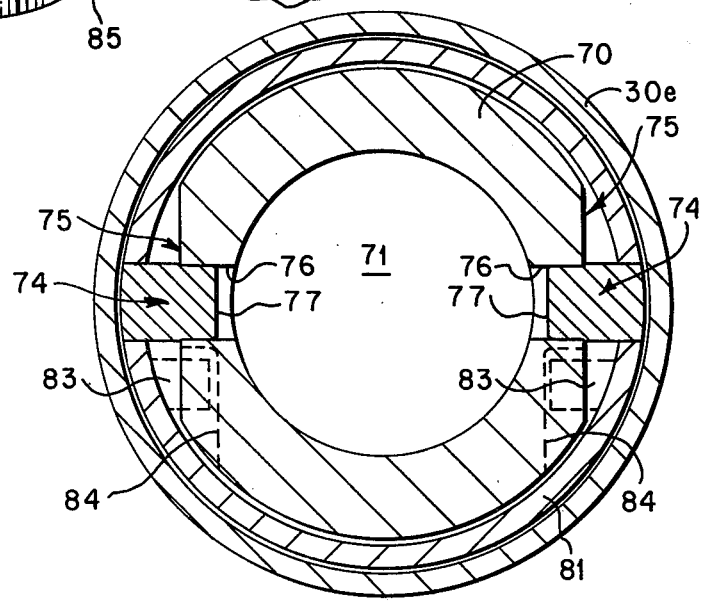
FIG. 11 is a horizontal sectional view taken along line 11—11 of FIG. 4A.

Valve closure means 55 for safety valve 20 includes first seat means 60, ball member 70 and a pair of pivot arms 74 connected therebetween. Bore 71 extends radially through ball member 70 and is sized to be compatible with longitudinal passageway 32. Flat surfaces 75 are machined parallel to each other on opposite sides of ball 70. Two small openings 76 are drilled through opposite sides of ball 70 normal to their associated flat surface 75 and bore 71. Each pivot arm 74 has a pivot pin 77 projecting therefrom and sized to fit within opening 76. Boss 78 is formed on the end of each pivot arm 74 projecting from the same surface on pin 77. Boss 78 is sized to be received in annular groove 79 on the exterior of upper movable valve seat 60. Notches 80 are cut in the end of valve seat 60 for use in assembling seat 60, pivot arms 74 and ball member 70 as shown in FIG. 10. Valve seat 60 and pivot area 74 provide means for connecting valve closure means 55 to operating sleeve 40 whereby longitudinal movement of sleeve 40 causes longitudinal movement of valve closure means 55 within housing means 30.

Figure 8:
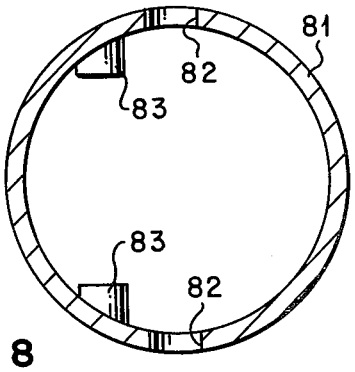
FIG. 8 is a horizontal cross-sectional view taken along line 8—8 of FIG. 7.

Valve closure means 55 also includes rotating sleeve 81 which is slidably disposed within housing subassembly **30*e* and surrounds ball member 70 and valve seat 60. Rotating sleeve 81 is a hollow cylinder with a pair of rectangular slots 82 cut longitudinally through diametrically opposite sides of sleeve 81. Pivot arms 74 are sized to slide longitudinally within slots 82. As shown in FIG. 8, a pair of rotating pins 83 project into the bore of sleeve 81 offset from slots 82 and the centerline of sleeve 81. An oblique slot 84 is milled in each ball surface 75 offset from its associated opening 76. Rotating pins 83 are sized to fit within their respective slot 84. This configuration results in rotation of ball member 70 around pivot pins 77 by longitudinal movement of rotating pins 83 with respect to pivot pins 77. Such relative longitudinal movement can occur by holding pivot arms 74 fixed relative to housing means 30 and sliding rotating sleeve 81 or by holding rotating sleeve 81 fixed relative to housing means 30 and sliding pivot arms 74. The amount of relative longitudinal movement is determined by the length of slots 82 and pivot arms 74**. A similar pair of offset pins for rotating a ball member is shown in U.S. Pat. No. 3,826,462.

Rotating sleeve 81 rests on disc 85. For ease of assembly, sleeve 81 and disc 85 are two separate pieces. Biasing means or coiled spring 88 is disposed within housing subassembly **30*e* between disc 85 and internal shoulder 89 of housing subassembly 30*f*. When operating sleeve 40 moves longitudinally in the one direction, force is transmitted to ball member 70 by both the engagement of sealing surface 62 with the exterior of ball member 70 and the engagement of pivot arms 74 with openings 76. Both of these engagements tend to move ball member 70 longitudinally in the one direction but do not cause rotation of ball member 70. However, operating sleeve 40 does not directly contact rotating sleeve 81. Biasing means 88 applies force to sleeve 81 via disc 85 which tends to hold sleeve 81 abutting internal shoulder 99 of housing subassembly 30*a*. If there is no difference in fluid pressure across the exterior of sealing surface 62 and the exterior of ball member 70, longitudinal movement of operating sleeve 40 in the one direction will move ball member 70 longitudinally in the same direction. Since biasing means 88 tends to hold rotating sleeve 81 fixed relative to housing means 30, this longitudinal movement results in relative movement between pins 77 and 83 causing rotation of ball member 70 to align bore 71 with longitudinal passageway 32**.

If a difference in pressure exists across sealing surface 62 and the exterior of ball member 70, this pressure difference tends to prevent rotation of ball member 70 by maintaining contact between surface 62 and ball member 70. If ball member 70 cannot rotate, forces generated by longitudinal movement of ball member 70 in the one direction are transmitted to rotating sleeve 81 by pin 83. If this force exceeds the force generated by biasing means or spring 88 to hold sleeve 81 against shoulder 99, sleeve 81 will move longitudinally in the one direction within housing means 30 compressing spring 88. Thus, spring 88 limits the maximum differential pressure which can be present while ball member 70 rotates relative to sealing surface 62. This feature protects sealing surface 62 and ball member 70 from flow cutting which occurs when ball valves are opened with too high a difference in pressure.

Spring 88 also limits the force which can be applied to pins 77 and 83. As previously noted, spacer 72 limits the length of travel of operating sleeve 70 in the one direction. By properly selecting the length of spring 88, operating 40 will be stopped prior to "stacking" or making spring 88 solid. Thus, the maximum force which can be applied to pins 77 and 83 is directly proportional to the spring constant for biasing means 88 times its displacement. The present invention allows safety valve 20 to be designed such that ball member 70 is never rotated open with an excessive differential pressure nor are excessive forces applied to pins 77 and 83.

A lower movable valve seat or second seat means 90 is positioned within longitudinal passageway 32 abutting the exterior of ball member 70 opposite from upper valve seat 60. The primary purpose for lower valve seat 90 is to block sand or other particulate matter from damaging valve closure means 55. Valve seat 90 is a generally cylindrical hollow tube slidably disposed within disc 85, biasing means 88 and housing subassemblies **30*e* and 30*f*. Flange 91 is formed on the end of valve seat 90 which abuts ball 70. Wiping or sealing surface 92 on the interior of flange 91 has a radius compatible with the exterior of ball 70. Flange 91 also provides shoulder 93 on the exterior of valve seat 90. A light coiled spring 94 surrounds the exterior between shoulder 93 and disc 85. Spring 94 maintains wiping surface 92 in contact with ball member 70 as it rotates and moves longitudinally within housing means 30. Seal ring 95 is carried on the interior of housing subassembly 30*f* and contacts the exterior of valve seat 90. Wiping surface 92 and seal ring 95 cooperate to prevent sand or other particulate matter from accumulating around spring 88 which might prevent spring 88 from contracting as designed. Port means 66** in housing subassembly 30*e* also eliminate the need for any formation fluid flow from below ball 70 while pressure differences is safety valve 20 are being equalized. The equalizing flow path minimizes the opportunity for sand to accumulate around spring 88.

Operating Sequence

Figure 2A:
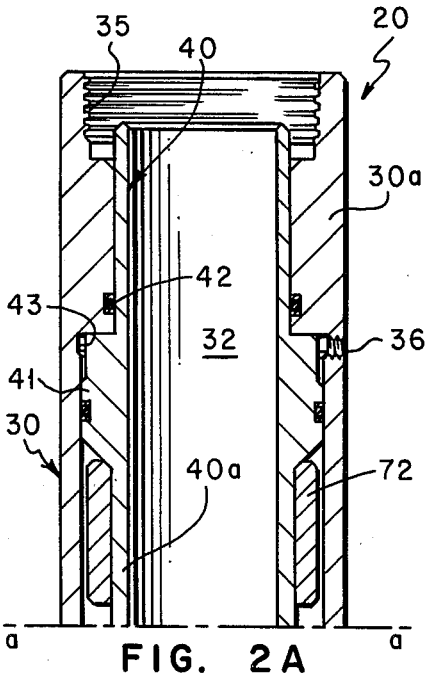
FIGS. 2A, B, C and D are drawings in longitudinal section showing a subsurface safety valve incorporating the present invention with its valve closure means in its first or closed position.
Figure 2B:
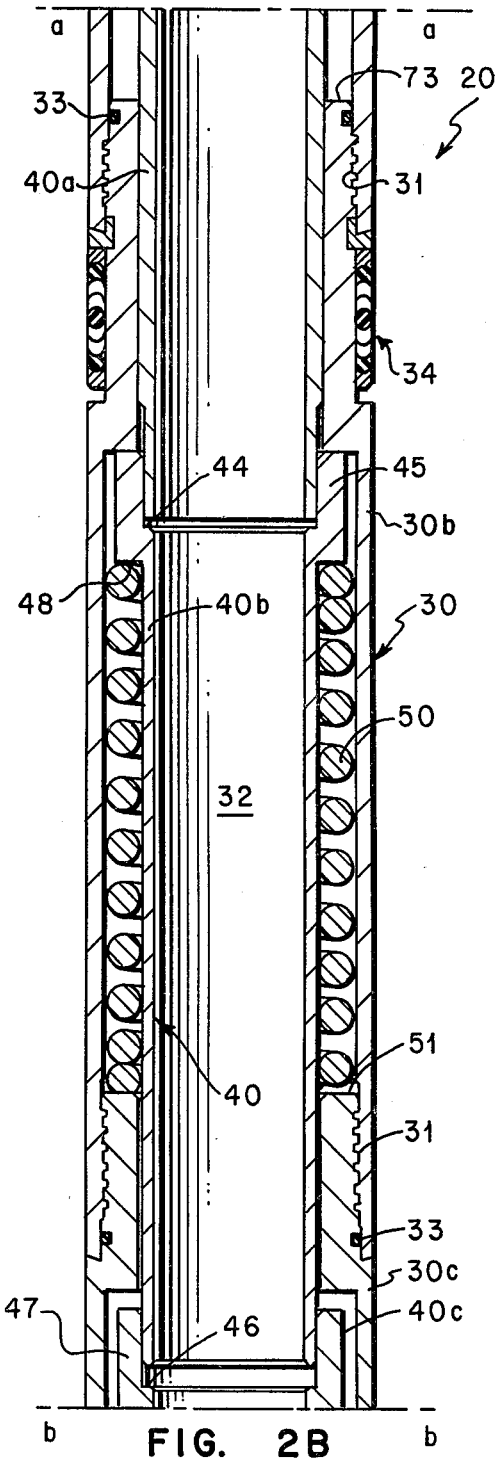

In FIGS. 2A, B, C and D safety valve 20 is shown in its first or closed position. Formation fluid flow through passageway 32 is blocked by the exterior of ball 70 contacting sealing surface 62 and annular seal means 63 contacting seating surface 64 closing the equalizing flow path. Resilient means 50 have moved operating sleeve 40 in the other direction displacing control fluid from chamber 43.

Figure 3A:
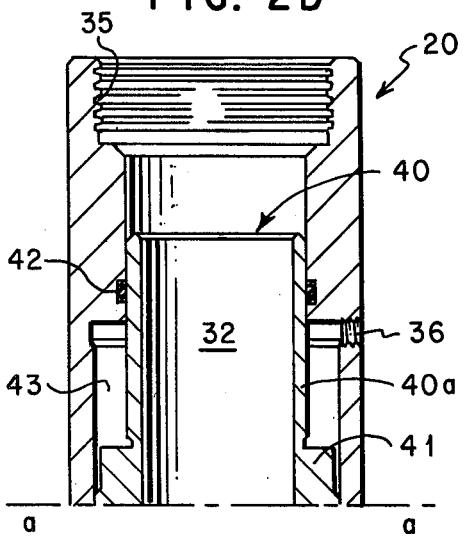
FIGS. 3A, B and C are drawings in longitudinal section with portions broken away showing the safety valve of FIGS. 2A–D with the valve closure means in its second or equalizing position.
Figure 3B:
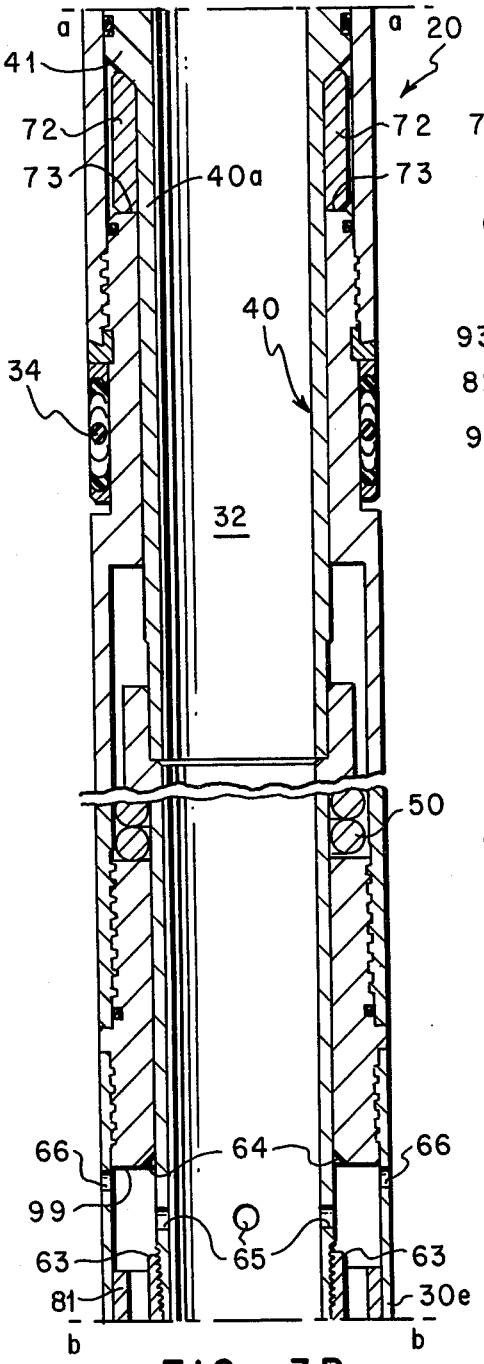
Figure 3C:
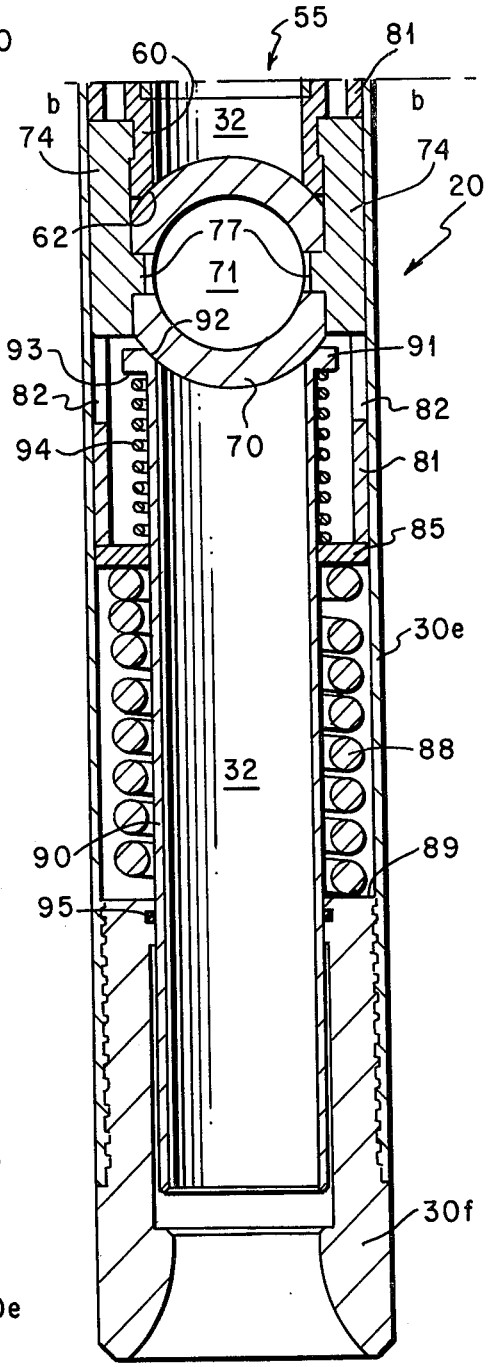

Generally, when safety valve 20 is closed in a producing well, a difference in pressure will quickly develop across sealing surface 62 which exceeds the safe operating limits for rotating ball 70. Safety valve 20 can be reopened by applying control fluid pressure from the well surface to chamber 43 via conduit 27 and opening 36. When the force of control fluid pressure acting on piston means 41 exceeds the force generated by resilient means 50, operating sleeve 40 will move longitudinally in the one direction as shown in FIG. 3A. Longitudinal movement of sleeve 40 in the one direction can continue until spacer 72 contacts shoulder 73 as shown in FIG. 3B. As previously explained, upper movable valve seat 60 provides a means for connecting operating sleeve 40 to valve closure means 55 whereby the longitudinal movement of sleeve 40 causes longitudinal movement of valve closure means 55 within housing means 30. Thus, longitudinal movement of sleeve 40 in the one direction opens the equalizing path through port means 65 and 66. As previously noted, biasing means 88 and rotating sleeve 81 cooperate to prevent rotation of ball 70 as long as the pressure difference across sealing surface 62 exceeds a preselected safe value. Biasing means or spring 88 generates a force which opposes longitudinal movement of valve closure means 55 in the one direction. Operating sleeve 40 can overcome spring 88 allowing longitudinal movement in the one direction of rotating sleeve 81 away from shoulder 99 as shown in FIG. 3B. The exterior of ball 70 and sealing surface 62 remain in sealing contact as shown in FIG. 3C until the difference in pressure thereacross drops below the maximum safe value for rotating ball 70.

Figure 4A:
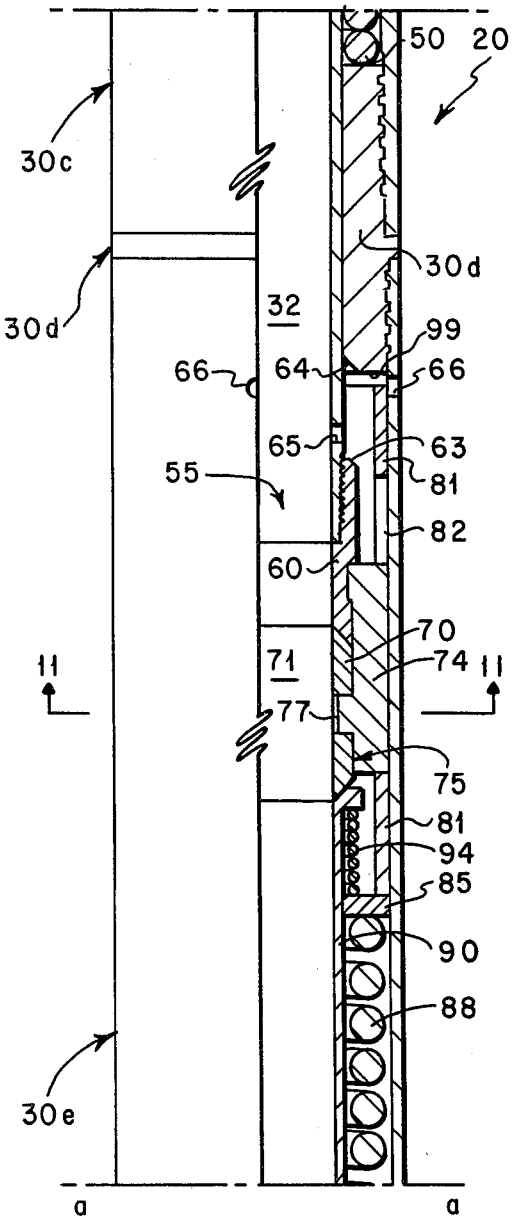
FIGS. 4A and B are drawings in longitudinal section with portions broken away showing the safety valve of FIGS. 2A–D with the valve closure means in its third or open position.
Figure 4B:
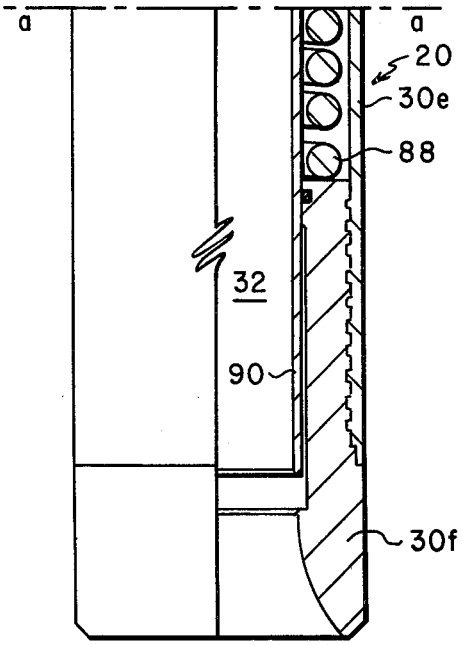
Figure 9:
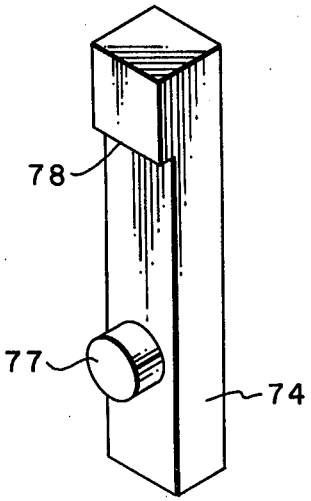
FIG. 9 is an isometric drawing of the pivot arm used to rotate the ball member of the valve closure means shown in FIG. 4A.

By maintaining control fluid pressure in chamber 43 above a preselected value, operating sleeve 40 moves longitudinally in the one direction its maximum allowed length of travel and then remains fixed relative to housing means 30. After the difference in pressure drops below the preselected value, biasing means 88 can move rotating sleeve 81 in the other direction toward shoulder 99. As previously noted, pivot arms 74 can slide longitudinally within slots 82 causing relative movement between pins 77 and 83. This relative movement causes rotation of ball 70 to align bore 71 with longitudinal passageway 32 and fully open safety valve 20 as shown in FIG. 4A. The force applied to pins 77 and 83 is always limited to a safe value by spring 88 during both longitudinal movement and rotation of ball 70.

Figure 2C:
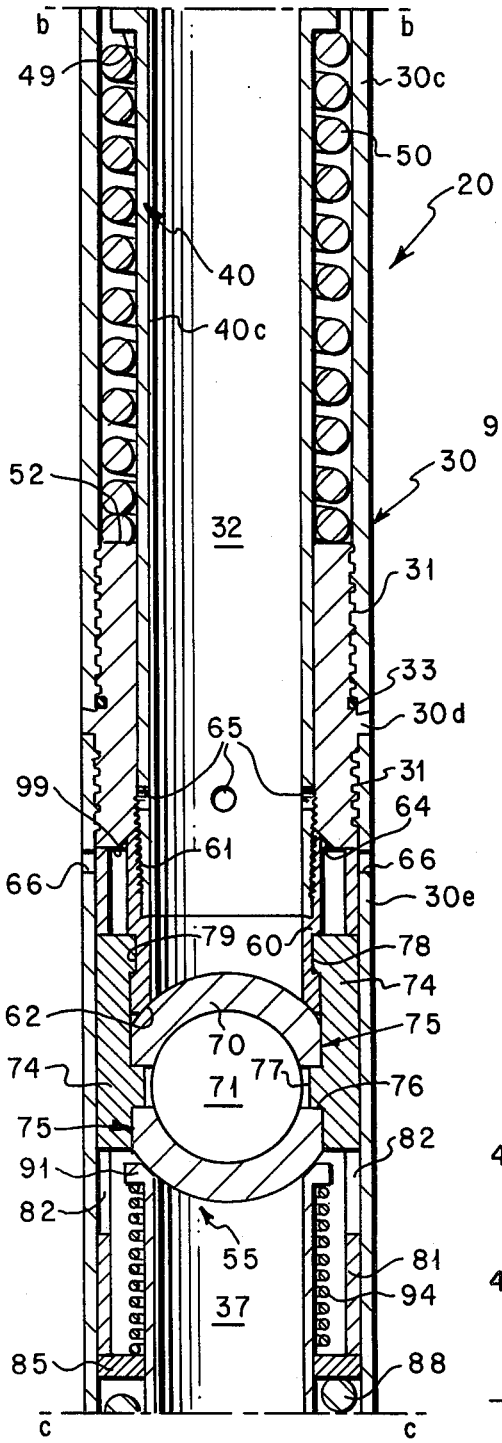
Figure 2D:
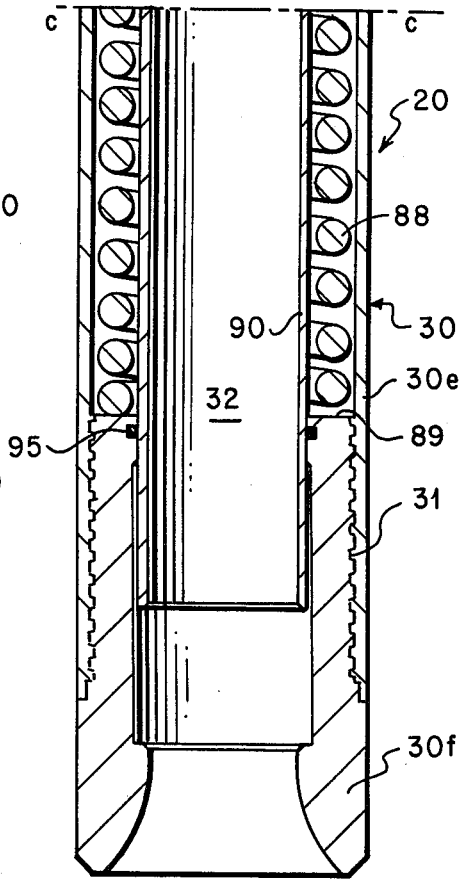

To close safety valve 20, control fluid pressure in conduit 27 is released at the wall surface. Resilient means 50 move operating sleeve 40 in the other direction causing piston means 41 to displace control fluid from chamber 43. Movement of operating sleeve 40 in the other direction is transmitted to ball 70 by pivot arms 74. However, movement of rotating sleeve 81 in the other direction is prevented by internal shoulder 99. Thus, pivot arms 74 can slide longitudinally in the other direction within slots 82. This longitudinal movement in the other direction causes relative movement between pins 77 and 83 to rotate ball 70 such that bore 71 is normal to passageway 32 as shown in FIG. 2C. Longitudinal movement of sleeve 40 in the other direction also causes annular seal means 63 to contact seating surface 64 closing the equalizing flow path.

In summary, longitudinal movement of operating sleeve 40 in the one direction shifts safety valve 20 from its first position to its second position. Biasing means 88 slides rotating sleeve 81 in the other longitudinal direction to shift safety valve 20 from its second position to its third position. Longitudinal movement of operating sleeve 40 in the other direction shifts safety valve 20 from its third position back to its first position.

Alternative Embodiment

If desired, port means 65 could be eliminated from operating sleeve subassembly 40*c*. Annular seal 63 and matching seating surface 64 could then be replaced by suitably designed stop shoulders. Eliminating the equalizing means in this manner would significantly reduce the cost of manufacturing safety valve 20. Fluid pressure differentials across ball 70 can be equalized by pumping down tubing string 23 from the well surface if port means 65 are not used. Biasing means 88 will still protect ball 70 and its associated components from excessive control fluid pressure and/or excessive fluid differential pressure thereacross even though port means 65 have been eliminated.

The foregoing description is only an explanation of the preferred embodiments. Various changes and modifications will be readily apparent to those skilled in the art without departing from the scope of the invention as defined in the claims.

What is claimed is:

1. A surface controlled subsurface safety valve having a ball type valve closure means for controlling fluid flow therethrough, comprising:

a. a housing means with a longitudinal passageway therethrough;

b. an operating sleeve and attached piston means slidably disposed within the longitudinal passageway;

c. the valve closure means disposed within the longitudinal passageway;

d. means for communicating control fluid pressure with the piston means;

e. means for connecting the valve closure means to the operating sleeve whereby longitudinal movement of the operating sleeve causes longitudinal movement of the valve closure means within the housing means;

f. biasing means which generates a force opposing longitudinal movement of the valve closure means in one direction; and g. the biasing means causing longitudinal movement of a part of valve closure means in the other direction to permit fluid flow therethrough after any difference in fluid pressures on opposite sides of the valve closure means have been equalized.

2. A safety valve as defined in claim 1, further comprising:

a. an equalizing means which is opened by longitudinal movement of the operating sleeve in the one direction; and b. the longitudinal movement of the operating sleeve in the one direction shifts the valve closure means from its closed position to its equalizing position and the biasing means moves a part of the valve closure means longitudinally in the opposite direction to shift the valve closure means from its equalizing position to its open position.

3. A safety valve as defined in claim 2, wherein the equalizing means further comprises:

a. an annular seal means formed on the exterior of the valve closure means;

b. a seating surface formed on the interior of the housing means and engageable by the annular seal means;

c. first port means extending through the operating sleeve and spaced longitudinally from the annular seal means; and d. the annular seal means engaging the seating surface when the valve closure means is closed and longitudinal movement of the operating sleeve in the one direction disengaging the annular seal means from the seating surface to allow fluid flow through the port means.

4. A safety valve as defined in claim 3, wherein the equalizing means further comprises a second port means extending radially through the housing means near the seating surface.

5. A safety valve as defined in claim 1, wherein the valve closure means further comprises:

a. a ball member with a bore therethrough;

b. a pair of pivot arms which engage the ball member on opposite sides of its bore;

c. a rotating sleeve which engages the ball member offset from the pivot arms;

d. a first seat means attached to the operating sleeve and contacting the exterior of the ball member;

e. the pivot arm engaged with both the first seat means and the ball member whereby the operating sleeve, first seat means, pivot arms and ball member move longitudinally within the housing means;

f. the rotating sleeve slidably disposed between the housing means and the ball member; and g. the biasing means abutting the rotating sleeve whereby longitudinal movement of the rotating sleeve in the other direction will rotate the ball to align its bore with the flow passageway and allow fluid flow through the safety valve.

6. A safety valve as defined in claim 5, wherein the pivot arms each have a pivot pin which engages the ball member normal to its bore, and the rotating sleeve has a pair of rotating pins which engage the ball member offset from the pivot pins.

7. A safety valve as defined in claim 5, wherein the valve closure means further comprises a second seat means which contacts the ball member opposite from the first seat means.

8. A safety valve as defined in claim 5, wherein the force used to rotate the ball member to align its bore with the flow passageway, is directly proportional to the force generated by the biasing means and does not vary with control fluid pressure.

9. A surface controlled subsurface safety valve having a ball type valve closure means for controlling fluid flow therethrough, comprising:

a. a housing means with a longitudinal passageway extending therethrough;

b. an operating sleeve and attached piston means slidably disposed within the longitudinal passageway;

c. the valve closure means disposed within the longitudinal passageway and having a first position blocking fluid flow through the longitudinal passageway, a second position equalizing any fluid pressure differential on opposite sides of the valve closure means, and a third position allowing fluid flow through the longitudinal passageway;

d. means for communicating control fluid pressure with the piston means;

e. means for connecting the valve closure means to the operating sleeve whereby longitudinal movement of the operating sleeve shifts the valve closure means from its first position to its second position;

f. means for limiting the maximum distance of longitudinal movement of the operating sleeve in the one direction;

g. biasing means which generates a force opposing movement of the valve closure means from its first position to its second position;

h. an equalizing passageway which is open when the valve closure means is in its second position; and i. the biasing means causing the valve closure means to shift to its third position after fluid pressures on opposite sides of the valve closure means have been equalized.

10. A safety valve as defined in claim 9, wherein longitudinal movement of the operating sleeve in one direction shifts the valve closure means from its first position to its second position and the biasing means moves part of the valve closure means longitudinally in the other direction to cause shifting from its second position to its third position.

11. A safety valve as defined in claim 10, wherein the equalizing passageway comprises:

a. an annular seal means formed on the exterior of the valve closure means;

b. a seating surface formed on the interior of the housing means and engageable by the annular seal means;

c. first port means extending through the operating sleeve and spaced longitudinally from the annular seal means;

d. the annular seal means engaging the seating surface when the valve closure means is closed and longitudinal movement of the operating sleeve in the one direction disengaging the annular seal means from the seating surface to allow fluid flow through the port means; and e. a second port means extending radially through the housing means near the seating surface.

12. A safety valve as defined in claim 10, wherein the valve closure means further comprises:

a. a ball member with a bore therethrough;

b. a pair of pivot arms which engage the ball member on opposite sides of its bore;

c. a rotating sleeve which engages the ball member offset from the pivot arms;

d. a first seat means attached to the operating sleeve and contacting the exterior of the ball member;

e. the pivot arms engaged with both the first seat means and the ball member whereby the operating sleeve, first seat means, pivot arms and ball member arms longitudinally within the housing means;

f. the rotating sleeve slidably disposed between the housing means and the ball member; and g. the biasing means abutting the rotating sleeve whereby longitudinal movement of the rotating sleeve in the other direction will rotate the ball to align its bore with the flow passageway and allow fluid flow through the safety valve.

13. A safety valve as defined in claim 1, further comprising means for limiting the maximum distance of longitudinal movement of the operating sleeve in the one direction.

14. A safety valve as defined in claim 13, wherein the limiting means comprises:

a. a spacer ring disposed around the operating sleeve and engageable by the piston means; and b. a shoulder formed on the interior of the housing means and engageable by the spacer ring whereby longitudinal movement of the operating sleeve is limited by engagement between the piston means, spacer ring and interior shoulder.

* * * * *